US005442367A

United States Patent [19]

Naito et al.

[11] Patent Number: 5,442,367

[45] Date of Patent: Aug. 15, 1995

[54] PRINTED ANTENNA WITH STRIP AND SLOT RADIATORS

[75] Inventors: Motoyuki Naito, Ichikawa; Koichi Ito, Chiba, both of Japan

[73] Assignee: Sumitomo Metal Mining Co., Ltd., Tokyo, Japan

[21] Appl. No.: 112,386

[22] Filed: Aug. 27, 1993

[30] Foreign Application Priority Data

Sep. 3, 1992 [JP] Japan ..... 4-260804

[51] Int. Cl.[6] ..... H01Q 1/38; H01Q 21/24

[52] U.S. Cl. ..... 343/700 MS; 343/767; 343/725

[58] Field of Search ..... 343/700 MS, 767, 725; H01Q 1/38, 13/08, 21/00–21/24

[56] References Cited

U.S. PATENT DOCUMENTS

| | | | |
|---|---|---|---|
| 4,486,758 | 12/1984 | de Ronde | 343/700 MS |
| 4,590,478 | 5/1986 | Powers et al. | 343/700 MS |
| 4,660,047 | 4/1987 | Wolfson | 343/700 MS |

FOREIGN PATENT DOCUMENTS

| | | |
|---|---|---|
| 0243289 | 10/1987 | European Pat. Off. . |
| 0519508 | 12/1992 | European Pat. Off. . |
| 336525 | 5/1992 | Japan . |
| 90/0336525 | 7/1992 | Japan . |
| 176212 | 12/1992 | Japan . |
| 2046530 | 11/1980 | United Kingdom . |
| 2219143 | 11/1989 | United Kingdom . |

OTHER PUBLICATIONS

"Improved Design of Series-Fed Circularly Polarised Printed Linear Arrays", K. Ito et al., I.E.E.E. Proc., Dec. 1986, No. 6.

*Primary Examiner*—Michael C. Wimer

*Attorney, Agent, or Firm*—Ostrager, Chong & Flaherty

[57] ABSTRACT

A printed antenna comprises a window formed in a grounded conductor provided on one surface of an insulator substrate, a first strip conductor formed in the window, and a second strip conductor provided on the other surface of the insulator substrate.

6 Claims, 6 Drawing Sheets

PRINTED ANTENNA WITH STRIP AND SLOT RADIATORS

BACKGROUND OF THE INVENTION

This invention relates to a printed antenna for microwave transmission and reception.

The printed antenna in which antenna elements and a transmission line are formed on a printed hoard has many advantages that it can he thin, light and small, it can he made in mass-production, and it can be formed integrally with electronic circuits. Such a printed antenna is used as an antenna for microwave transmission and reception of satellite broadcast, portable communication device or the like. There are various types of printed antennas. One type of printed antenna, has a linear strip antenna element having its length approximately half the wavelength of signal to be transmitted and received is used and a window is provided in a grounded conductor by cutting out the same to obtain a broad or wide band. This type of antenna is stable for its operation since it has only one resonance mode, compared with another type of printed antenna utilizing a patch type of element.

The window provided for widening a frequency hand of a strip antenna element is wide in its width and has a length more than half the wavelength of a signal to be transmitted and received. Since the window also functions as a slot antenna element, which is not desirable, the radiation from the window becomes a source of spurious radiation for a main polarized wave of the strip antenna element. As a means for suppressing the spurious radiation, the provision of projecting portions of the grounded conductor within the window at the center portion in the lengthwise direction of the strip antenna element was proposed by the same inventor in U.S. Pat. No. 5,317,324. Furthermore, the radiation from the window is reduced by spacing the end of the window away from the transmission line. In such a case, the provision of a projecting portion on the transmission line in the position of the strip antenna element was proposed by the same inventor (Japanese Patent Application 336525/1990).

When the strip antenna element provided with the window constructed so that spurious radiation is suppressed by the above-mentioned means is combined with a slot antenna element and the difference in phase of supplement of power between these linear elements are disposed 90°, the electric field has a phase difference of 90° in time and at the same time constitutes a combination of spatially crossed oscillating electromagnetic fields to effectively radiate a circularly polarized wave since the electric field radiated from the strip antenna and the electric field radiated from the slot antenna are spatially perpendicular to each other. Although the explanation of the antenna is directed to a transmitting antenna, it should he understood that the transmitting antenna can also he used as a receiving antenna due to duality of electromagnetic field.

FIGS. 8 through 10 show a conventional printed antenna constructed by a combination of the above-mentioned linear elements for radiating circularly polarized wave. Referring to these FIGS. 8 through 10, FIG. 8 is a general plan view showing a single unit of a printed antenna constructed by using a conventional window provided with a strip antenna element, FIG. 9 is a cross-section view taken along line 9—9 of FIG. 8 showing the printed antenna together with a reflector p late, and FIG. 10 is a plan view showing a main portion of the conventional printed antenna constructed by a plurality of units of the printed antenna for radiating a circularly polarized wave by a combination of linear elements.

In FIGS. 8 through 10, reference numeral 10 indicates a strip antenna element (strip conductor), 12 indicates a window, 13 indicates an input and output portion, 14 indicates a transmission line, 15 and 16 indicate insulator substrates, 18 indicates a grounded conductor, 19 indicates a reflector plate, 20 indicates a slot antenna element, 21 indicates projecting portions in the window, and 22 indicates a projecting portion of the transmission line. The projecting portions within the window 12 are provided for suppressing spurious radiation from the window, and tapered portions are provided window near the transmission reducing spurious radiation from the window by spacing portions of the end of the window away from the transmission line 14 to weaken the connection between the window and the transmission line. Furthermore, the projecting portion 22 of the transmission line is provided for spacing the whole end of the window away from the transmission line. Explanations of the functions of these conventional printed antennas are made in the above-mentioned U.S. patent(s) and are incorporated herein. To summarize, in the following brief description is given:

Firstly, an explanation on the width of the window will he made. As the width of the window is wider, the property of the strip antenna element is expanded wider in a frequency band. However, in order to suppress the spurious radiation to a low level, it is desirable that the width of window should be narrow. Since the width of the window at the center portion thereof does not substantially affect the frequency property of the strip antenna element, the projecting portions are provided within the window for substantially narrowing the width of the window while maintaining the frequency property of the strip antenna element to be wide, and thus is capable of suppressing spurious radiation from the window.

Secondly, an explanation on the projecting portion of the transmission line will be made. The shorter the distance between the transmission line and antenna element is and the wider the superimposed portion thereof is, the closer the connection between the transmission line and the antenna element is. In general, the closer the connection is, the stronger the radiation from the antenna element is. However, with the strip antenna element disposed perpendicular to the transmission line, the area of the superimposed portions of the strip antenna element and the transmission line becomes at most the width of the strip antenna element times the width of the transmission line. When the transmission line is provided with the projecting portion, the connection between the transmission line and the strip antenna element can be closer since the superimposed portions of the transmission line and the strip antenna element become wider. Furthermore, with the transmission line provided with the projecting portion, the transmission line can be disposed to be spaced away from the end of window to reduce spurious radiation from the window, compared with the transmission line which is not provided with a projecting portion.

For the antenna for use in a portable communication device constructed by a few number of elements or the antenna for use in a satellite broadcasting transmission and reception constructed by a sub-array comprising a few number of elements, it is required to connect the antenna elements and the transmission line closely. However, with the conventional antenna in which the strip antenna element is provided with the window and is disposed to be perpendicular to the transmission line, and the transmission line is provided with projecting portion for obtaining close connection, the radiation property of the antenna element does not simply correspond to input impedance property and thus it is difficult to design the antenna element. Particularly, it is difficult to design an antenna for circularly polarized wave comprising a combination of a linear strip antenna element provided with a window and a linear slot antenna element. Furthermore, in case where the connection between the strip antenna element and the transmission line is made to be close, the superimposed portions of the window and the transmission line are wider than the superimposed portions of the strip antenna element and the transmission line, which results in greatly increased spurious radiation from the window. Furthermore, under such a condition, as the projecting portion provided within the window is intended to suppress spurious radiation, the position where the projecting portion is provided within the window, that is, the electric center of the strip antenna element is not consistent with the physical center of the length of the strip antenna element. Consequently, it is difficult to design the projecting portion within the window required for close connection with the transmission line.

In the meantime, FIG. 10 is a plan view showing a conventional printed antenna for radiating circularly polarized wave by a combination of linear elements. On designing the antenna elements using a plurality of pairs of elements, the connection between the strip antenna elements and the transmission line is not required to be close. Under such a condition, in case where the transmission line is provided with projecting portions, the correspondance between the radiation property of strip antenna element and the input impedance property is relatively easily obtained. Furthermore, in case where the transmission line is not provided with the projecting portions, spurious radiation from the window is suppressed to a very low level by providing the projecting portion within the window in the physical center position of length of strip antenna element since a desired connection between the strip antenna element and the transmission line can be obtained under a condition that the window and the transmission line are not closely superimposed. Thus, in case where a close connection with the transmission line is not required, the strip antenna element with little spurious radiation can be realized by adoption of the projecting portion of the transmission line or the projecting portion of the window, different from that of the case where a close connection is required. That is, the property of a single element required for a close connection and the property of plural elements not required for a close connection are quite different from each other. It should be understood that the design for the antenna using a sub-array comprising a multiplicity of elements not required for a close connection can be easily made, if the design data obtained by a single element is easily applicable to the design for plural elements.

SUMMARY OF THE INVENTION

It is, therefore, an object of the invention to provide a printed antenna for microwave transmission and reception in which its desinability is good, a frequency hand is wide and a crossed polarized wave property of an antenna element is good even in case of a single element, and thus a circularly polarized wave is good in case where a strip antenna element is combined with a slot antenna element.

In order to accomplish the object of the invention, there is provided a printed antenna which comprises a window formed in a grounded conductor provided on one surface of an insulator substrate, a first strip conductor formed in the window, and a second strip conductor provided on the other surface of the insulator substrate.

BRIEF DESCRIPTION OF THE DRAWINGS

The present invention will he now described in detail with reference to the preferred embodiments illustrated in the accompanying drawings in which.

DESCRIPTION OF PREFERRED EMBODIMENTS

To begin with, an explanation on the fundamental constructions of printed antennas in accordance with the present invention and the advantages obtained from the constructions will be made. In the present invention, even under a condition that a window 12 is spaced away from a transmission line 14, a strip antenna element 10 is effectively excited by connecting a window provided strip antenna element with a transmission line by means of another strip conductor or a probe 11, and at the same time spurious radiation from the window can be reduced. Furthermore, since the probe is electromagnetically connected to the transmission line through a gap, the correspondence between radiation property and input impedance property can be made easily even in case of a single element of window provided strip antenna, and the difference between the antenna constructed by a multiplicity of elements and the antenna constructed by a few elements can be reduced. Consequently, the designability of antenna elements can be improved.

Figure 1:
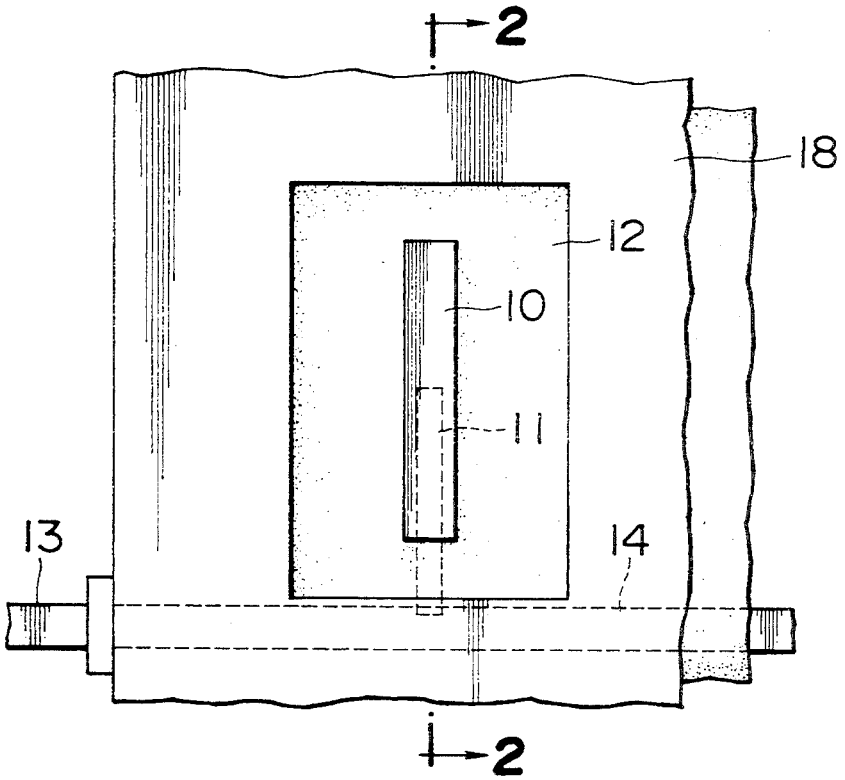
FIG. 1 is a plan view showing a first embodiment of a printed antenna in accordance with the present invention.
Figure 2:
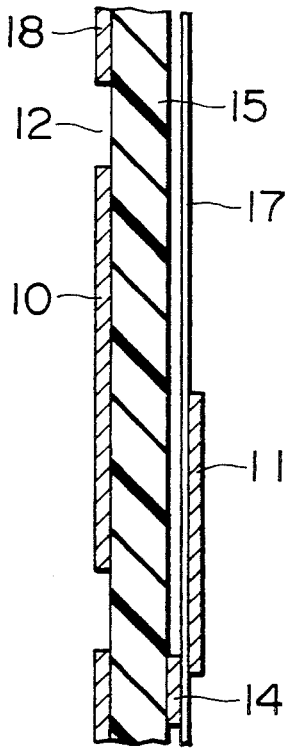
FIG. 2 is a cross-section view taken along line 2—2 of FIG. 1.
Figure 3:
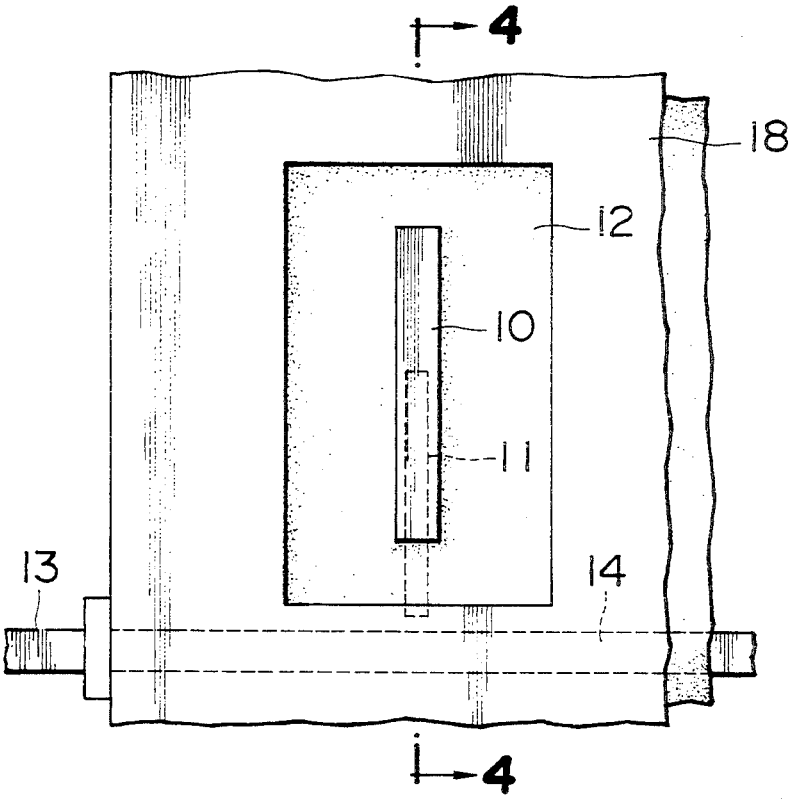
FIG. 3 is a plan view showing a second embodiment of a printed antenna in accordance with the present invention.
Figure 4:
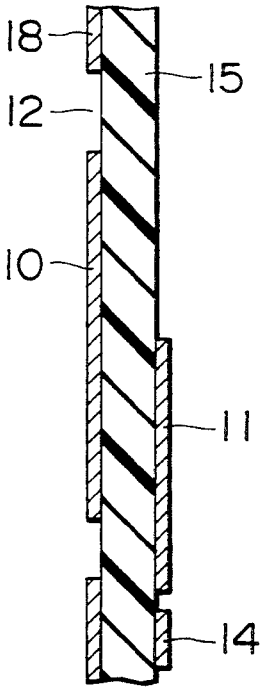
FIG. 4 is a cross-section view taken along line 4—4 of FIG. 3.

The probe 11 and the center conductor of the transmission line are in separate layers, and may be superimposed on one another as seen in FIGS. 1 and 2 or may he disposed in a plane as seen in FIGS. 3 and 4. The first end of probe 11 on the side of the transmission line may be provided with a gap through which a desired connection between the probe and the transmission line can be obtained. It is desired that the first end of the probe is positioned nearer the side of the transmission line than the first end of the strip antenna element on the side of the transmission line. This is to avoid the increase of spurious radiation which would be generated when the connection between the transmission line and the window is stronger than the connection between the strip antenna element and the transmission line. When the probe 11 is long and the second end of the probe remote from the transmission is disposed in the same position as that of the second end of the strip antenna element remote from the transmission line, a resonance frequency cannot be determined by the length of the strip antenna element, but also the resonance property of the probe and the resonance property of the strip antenna element are superimposed to generate a double peak property and thus it is difficult to design the antenna. Therefore, it is desired that the first and second ends of the probe should he disposed nearer the transmission line than the corresponding ends of the strip antenna element.

A reflector plate is usually disposed at a distance $\lambda/4$ from the strip conductor, where $\lambda$ is a wave length of the frequency used. However, the distance is not limited to that value as far as the purpose of radiating an electromagnetic wave on either side of the antenna is accomplished. Furthermore, another insulator substrate may be sandwiched between the insulator substrate and the reflector plate to attach the reflector plate to the insulator substrate.

The insulator substrate is not limited as long as the thickness of the insulator substrate is uniform and a desired dielectric property is obtained.

Now, an explanation of the embodiments in accordance with the present invention will be made specifically with reference to the drawings. Referring now to FIGS. 1 and 2, a strip antenna element 10 comprising a strip conductor of 1.0 mm in width and 8.3 mm in length is formed on one surface of an insulator substrate 15 of 2.0 mm in thickness in the center .portion of a rectangular window 12 of 13 mm in length and 5.5 mm in width. The center portion of the window 12 and the center portion of the strip conductor 10 are located to be substantially coincident to each other. Furthermore, a probe 11 comprising a strip conductor of 1.0 mm in width and 5.5 mm in length is formed on one surface of an insulator film substrate 17 of 25 $\mu$m in thickness and a transmissiom line 14 for excitation is formed on the other surface of the insulator film substrate 17. In addition, the probe and the transmission line are disposed so that they are superimposed 2.2 mm, the end of the window is spaced away from the transmission line at a distance of 1.0 mm, and the transmission line is terminated open at a distance of 10 mm (half of wavelength on the transmission line) from the strip antenna element.

Referring to FIGS. 3 and 4, with the printed antenna shown in these FIGS. 3 and 4, the probe 11 is formed on the other surface of the insulator substrate 15 without provision of the insulator substrate 17 and disposed in the same plane as that of the center conductor 14 of the transmission line.

Figure 5:
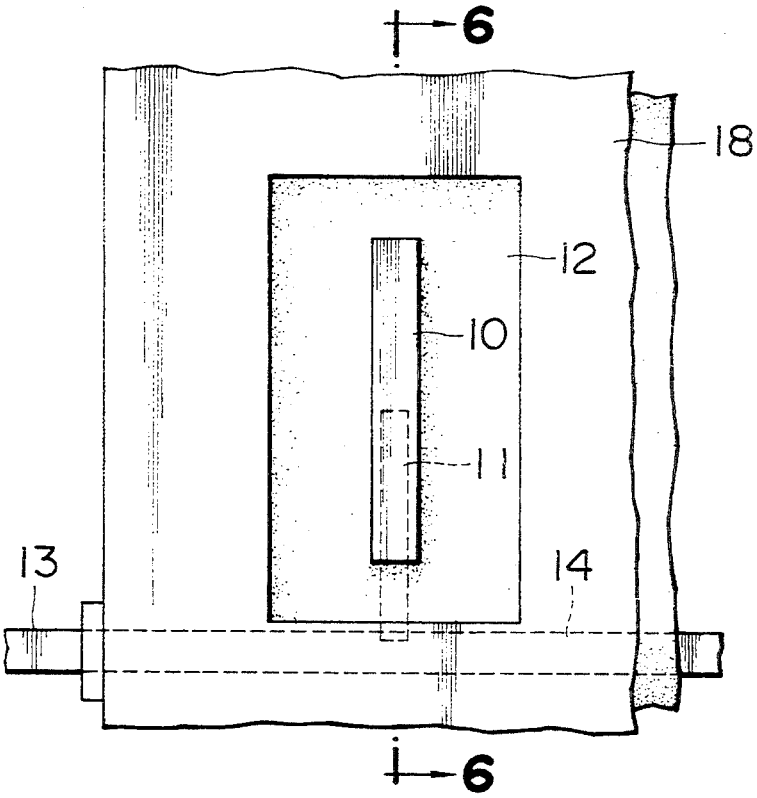
FIG. 5 is a plan view showing a third embodiment in which the printed antenna is provided with a reflector plate for circularly polarized wave transmission and reception.
Figure 6:
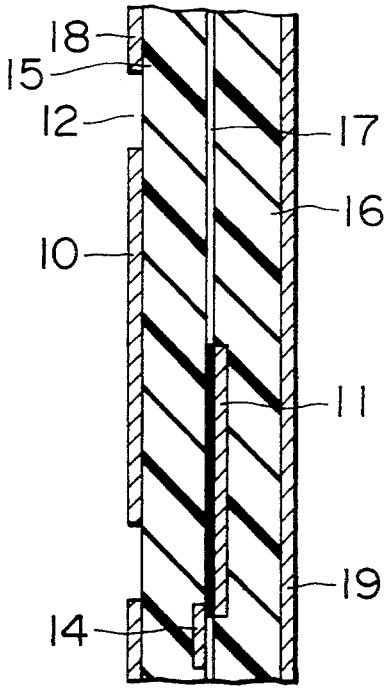
FIG. 6 is a cross-section view taken along line 6—6 of FIG. 5.

Referring to FIGS. 5 and 6, they show that a reflector plate 19 is attached to the printed antenna through an additional insulator substrate 20 of 2.00 mm in thickness to form an printed antenna provided with a reflector plate for linearly polarized wave transmission and reception. In FIGS. 5 and 6, with a single element, a return loss is more than 20 dB at a frequency of 11.9 GHz and an input impedance matching is obtained. Under such a condition and when the terminal ends of the transmission line are treated as matching loads, antenna properties are measured. As a result, in front of the antenna, the radiation power strength of main polarized wave becomes maximum at a frequency of 11.9 GHz, and the percent frequency band width in which the radiation power strengh is 3 dB less than the maximum value is more than 9% and the percent frequency band width at which the crossed polarized wave suppression ratio becomes −25 dB is more than 5%.

Figure 8:
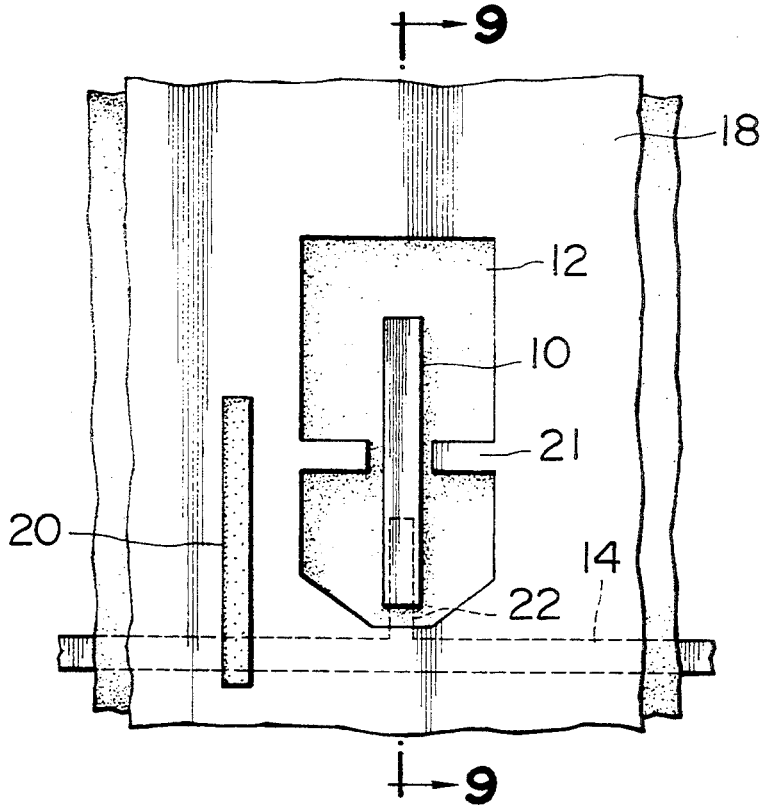
FIG. 8 PRIOR ART
FIG. 8 is a plan view showing a single element of conventional printed antenna constructed by a window provided antenna element.
Figure 9:
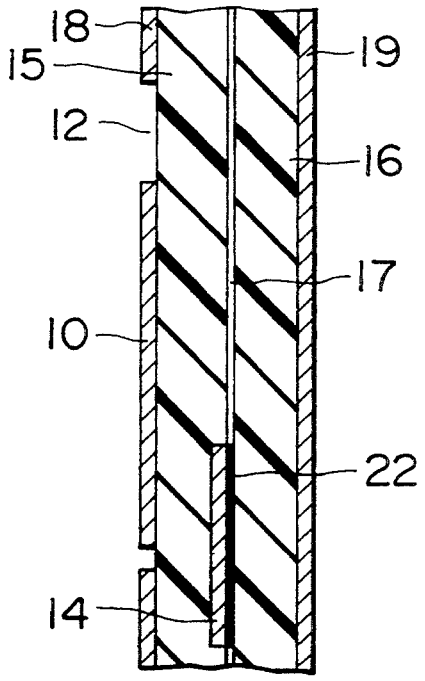
FIG. 9 PRIOR ART
FIG. 9 is a cross-section view taken along line 9—9 of FIG. 8 showing the antenna together with a reflector plate.
Figure 10:
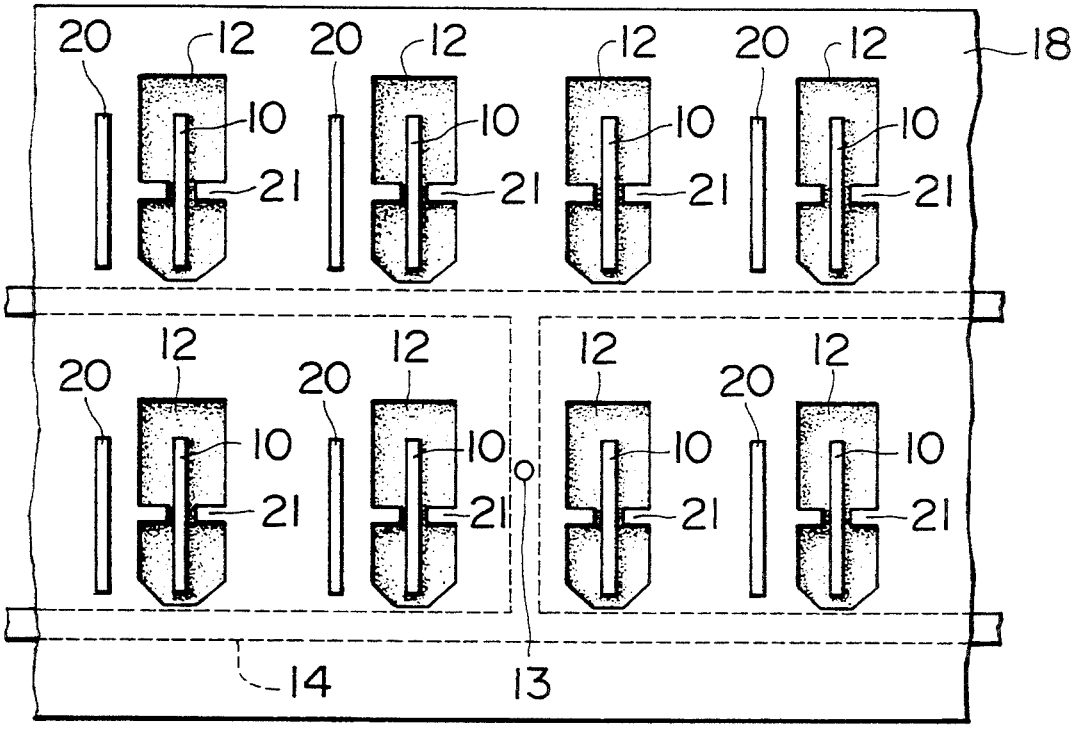
FIG. 10 PRIOR ART
FIG. 10 is a plan view showing a conventional printed antenna for radiating circularly polarized wave by means of a combination of linear elements.

For comparison, an antenna in which the slot antenna element shown in FIGS. 8 and 9 is covered with a conductor, the window is of 13 mm in whole length and of 5.5 mm in width, the width of the projecting of the window is made to be 0.4 mm, and the tapered portion of the window is of 1.0 mm. In addition, the antenna is constructed so that the end of the window is disposed at a distance of 0.1 mm from the transmission line, the transmission line is provided with the projecting portion of 4.0 mm in length, the strip antenna element is of 0.6 mm in width and of 7.5 mm in length and the end of the window is disposed at a distance of 0.6 mm from the end of the strip element. At that time, the return loss becomes 20 dB at a frequency of 11.8 GHz and thus the impedance matching is obtained. Under such a condition and when the terminal ends of the transmission line are treated as matching loads, antenna properties are measured. As a result, the frequency at which the radiation power strength of main polarized wave becomes maximum is 11.2 GHz and thus is not consistent with the frequency at which the return loss becomes maximum. At that time, the percent frequency band width at which the crossed polarized wave suppression ratio becomes −25 dB is less than 3%.

Furthermore, the antenna used for comparison is made in a similar manner to the antenna shown in FIGS. 5 and 6 except for the above-mentioned conditions.

From the above, it should be understood that, compared with a conventional window provided strip antenna element, in the construction of antenna in accordance with the present invention, the crossed polarized wave property is good throughout a very wide band even in case of a single element, only the strip antenna element is effectively excited , and the radiation property of the strip antenna element can be made to Be coincident with the input impedance property.

Figure 7:
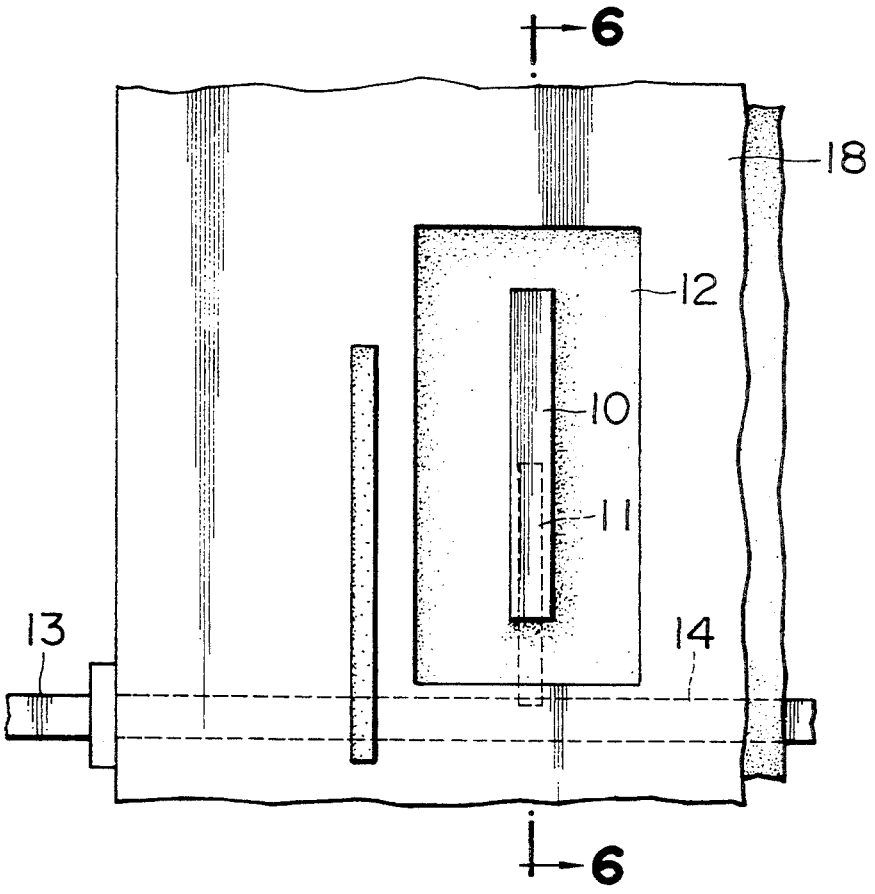
FIG. 7 is a plan view showing a fourth embodiment in which the printed antenna is provided with a reflector plate for circularly polarized wave transmission and reception.

FIG. 7 is a view showing an example of a printed antenna for circularly polarized wave transmission and reception constructed by an addition of a slot antenna element to the antenna shown in FIGS. 5 and 6. Since it is known that the crossed polarized wave property of the slot antenna element is good, it is clear that circularly polarized wave property of the printed antenna shown in FIG. 7 is good.

What we claim:

1. A printed antenna comprising:

an insulator substrate having opposite surfaces thereon;

a grounded conductor layer provided on one surface of said insulator substrate having a window cut out in said conductor layer, said window having a length in a lengthwise direction of the conductor layer;

a strip antenna element provided on said one surface of said insulator substrate and disposed within said window;

a transmission line provided on the opposite surface of said insulator substrate and arranged perpendicular to and spaced apart in the lengthwise direction from said strip antenna element; and a strip conductor provided as a probe for supplying power from said transmission line to said strip antenna element, said strip conductor being arranged in the lengthwise direction and disposed on said opposite surface of said insulator substrate having a first end spaced apart by a gap in proximity to said transmission line and a second end overlapped with said strip antenna element on said one surface of said insulator substrate.

2. A printed antenna according to claim 1, wherein said strip antenna element has first and second ends and extends in the lengthwise direction partially superimposed in parallel with said strip conductor, and the first and second ends of said strip conductor are each disposed closer in distance to said transmission line than the respective first and second ends of said strip antenna element.

3. A printed antenna according to claim 1, wherein said strip conductor is arranged in the same plane as said transmission line with its first end spaced apart by a gap from said transmission line.

4. A printed antenna according to claim 1, wherein an insulator layer is interposed between said strip conductor and said transmission line and the first end of said strip conductor is overlapped with but spaced apart from said transmission line by said insulator layer.

5. A printed antenna according to claim 1, further comprising a slot antenna element formed in said grounded conductor layer spaced apart from said window and arranged perpendicular to said transmission line for generating a circularly polarized wave.

6. A printed antenna according to claim 1, further comprising a reflector plate spaced apart from said strip conductor on said opposite surface of said insulator substrate.

* * * * *